US007182551B2

(12) United States Patent
Moreau

(10) Patent No.: US 7,182,551 B2
(45) Date of Patent: Feb. 27, 2007

(54) RE-ENFORCED COMPOSITE SHEET PILING SEGMENTS

(76) Inventor: Jeff Moreau, 225 Town Park Dr., Suite 300, Kennesaw, GA (US) 30144

( * ) Notice: Subject to any disclaimer, the term of this patent is extended or adjusted under 35 U.S.C. 154(b) by 66 days.

(21) Appl. No.: 10/286,564

(22) Filed: Nov. 1, 2002

(65) Prior Publication Data

US 2004/0086343 A1 May 6, 2004

(51) Int. Cl.
*E02D 5/02* (2006.01)

(52) U.S. Cl. ..... 405/274; 405/279; 405/281

(58) Field of Classification Search ..... 405/274–281, 405/272, 285
See application file for complete search history.

(56) References Cited

U.S. PATENT DOCUMENTS

| | | | | | |
|---|---|---|---|---|---|
| 999,334 | A | | 8/1911 | Pearson | |
| 1,851,864 | A | | 3/1932 | Nolte | |
| 1,855,113 | A | | 4/1932 | Nolte | |
| 2,128,740 | A | | 8/1938 | Dougherty | |
| 2,332,812 | A | | 10/1943 | Rieger | |
| 4,451,528 | A | * | 5/1984 | Krause | 428/300.4 |
| 4,524,042 | A | * | 6/1985 | Genba et al. | 264/211 |
| 4,674,921 | A | * | 6/1987 | Berger | 405/262 |
| 4,690,588 | A | | 9/1987 | Berger | |
| 4,863,315 | A | | 9/1989 | Wickberg | |
| 5,066,353 | A | * | 11/1991 | Bourdo | 405/274 |
| 5,122,417 | A | * | 6/1992 | Murakami et al. | 428/371 |
| 5,145,287 | A | | 9/1992 | Hooper et al. | |
| 5,286,553 | A | * | 2/1994 | Haraguchi et al. | 442/199 |
| 5,292,208 | A | | 3/1994 | Berger | |
| 5,294,461 | A | * | 3/1994 | Ishida | 427/293 |
| 5,333,971 | A | | 8/1994 | Lewis | |
| 6,000,883 | A | | 12/1999 | Irvine et al. | |
| 6,033,155 | A | | 3/2000 | Irvine et al. | |
| 6,053,666 | A | | 4/2000 | Irvine et al. | |
| 6,092,346 | A | | 7/2000 | Even et al. | |
| 6,106,201 | A | | 8/2000 | Bourdouxhe | |
| 6,257,800 | B1 | * | 7/2001 | Masters | 405/224 |
| 6,420,493 | B1 | * | 7/2002 | Ryckis-Kite et al. | 525/440 |

FOREIGN PATENT DOCUMENTS

| | | | |
|---|---|---|---|
| EP | 0545838 B1 | | 9/1993 |
| JP | 11-291393 | * | 10/1999 |
| JP | 411291394 | * | 10/1999 |

* cited by examiner

*Primary Examiner*—Frederick L. Lagman
(74) *Attorney, Agent, or Firm*—David E. Mixon; Bradley, Arant, Rose & White LLP

(57) ABSTRACT

A re-enforced composite sheet piling segment is disclosed. The segment of sheet piling includes multiple panels. The panels of the segment come together at an angle to form a corner. A re-enforcement is placed in the corner of the segment. The re-enforcement has a cross-sectional area that is convex shaped.

12 Claims, 3 Drawing Sheets

RE-ENFORCED COMPOSITE SHEET PILING SEGMENTS

BACKGROUND OF INVENTION

1. Field of the Invention

The invention relates generally to the composition and structure of building materials. More specifically, the invention relates to re-enforced sheet piling segments.

2. Background Art

Sheet piling is a construction material that is commonly used to build walls such as retaining sea-walls. The sheet piling is typically manufactured in individual segments that are attached to other segments to form a continuous wall. Since the segments are usually driven into the ground for stability, the segments may be several meters tall.

Sheet piling was once commonly made with steel or other metals. However, such piling may now be made with fiber re-enforced polymers (FRP). FRPs are formed out of a cured resin that has been re-enforced with fibers made of materials such as glass. The resin typically may be polyester or vinylester. While not as strong as steel, these materials offer better performance due to resistance to corrosion and other effects of chemical environments. Steel is an example of an "isotropic" material in that loads are distributed equally through out the material. In contrast, FRPs are generally considered "anisotropic" in that loads are not distributed equally in the material. For example, a composite material such as fiberglass is stronger along the orientation of the glass fibers than in other areas of the material.

While the FRP materials are resistant to corrosion, they will absorb water when exposed to that environment for long periods of time. This is a particular problem when sheet piling made from FRPs is used to build a seawall. If the sheet piling is exposed long enough and absorbs enough water, the structure may become weakened to the point of failure. Additionally, when FRP sheet piling is used to build a seawall, it also is exposed to active pressure from soil on one side of the wall while being exposed to a passive pressure from the water on the other side. Over time, the panels of material can weaken and the panels may deform or fail catastrophically under this type of pressure alone or combined with any weakening of the material from water absorption.

The potential for such failures are particularly acute at the joints that join the panels together and at any corner or edge of a panel. According to modeling, maximum tension occurs at the corner angles of the panels. Typical solutions involved re-enforcing points of potential failure on a panel of sheet piling with a concave shaped re-enforcement. However, these re-enforcements have proven insufficient to provide the additional strength to a panel made of anisotropic materials (such as FRPs).

SUMMARY OF INVENTION

In some aspects, the invention relates to a segment of sheet piling, comprising: a plurality of panels, where each panel is joined to at least one other panel at an angle; and a re-enforcement with a convex cross-sectional area that is located in the angle between the panels.

In other aspects, the invention relates to a segment of sheet piling, comprising: a plurality of panels, where each panel is joined to at least one other panel to form a corner; and means for re-enforcing the corner.

In other aspects, the invention relates to a segment of sheet piling, comprising: a polyurethane based material; and a matrix of fibers that re-enforce the polyurethane based material.

In other aspects, the invention relates to a method of manufacturing sheet piling, comprising: pulling fibers through a bath of a polyurethane based material; weaving the fibers into a matrix; forming the sheet piling in a die; and curing the sheet piling.

In other aspects, the invention relates to a method of manufacturing sheet piling, comprising: step for coating re-enforcing fibers with a polyurethane based material; step for forming the sheet piling; and step for curing the sheet piling.

In other aspects, the invention relates to a segment of sheet piling, comprising: a fiber re-enforced polymer material; a matrix of fibers that re-enforce the fiber re-enforced polymer material; and a water resistant coating that is applied to the surface of the segment.

Other aspects and advantages of the invention will be apparent from the following description and the appended claims.

BRIEF DESCRIPTION OF DRAWINGS

It should be noted that identical features in different drawings are shown with the same reference numeral.

DETAILED DESCRIPTION

Figure 1:
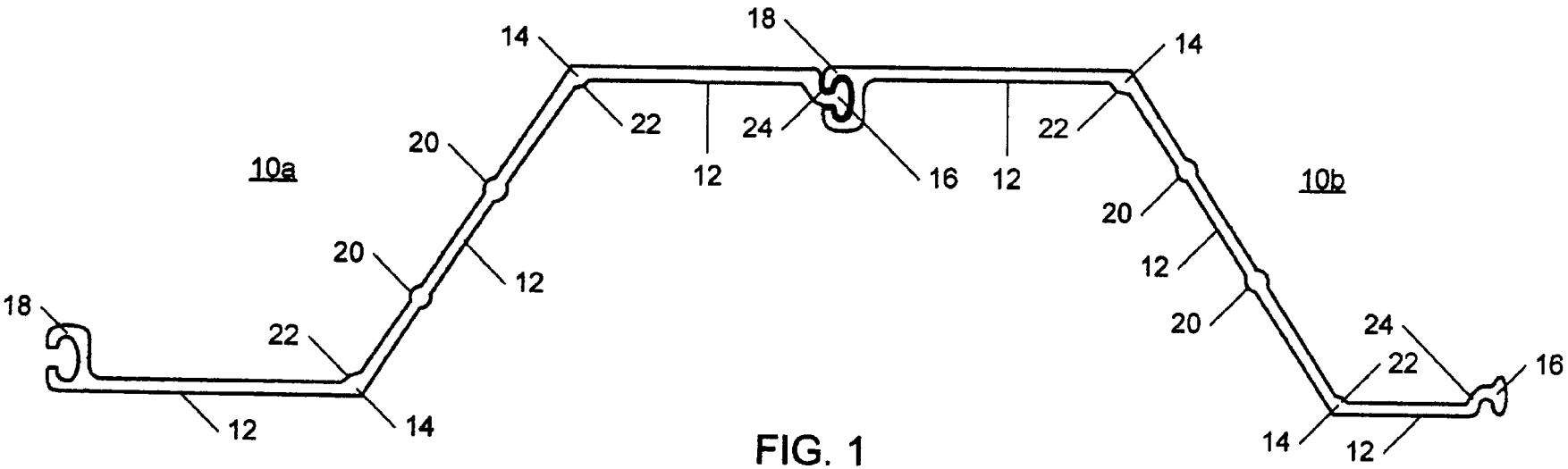
FIG. 1 shows an overhead view of two joined sheet piling segments in accordance with one embodiment of the present invention.

FIG. 1 shows an overhead view of two joined sheet piling segments 10*a* and 10*b* in accordance with one embodiment of the present invention. The two sheet piling segments or "sheets" shown are typically used in construction of sea-walls in either freshwater or saltwater environments. In the present embodiment, each sheet 10*a* and 10*b* is made of three distinct panels 12 that are roughly configured in a "Z" shaped arrangement. Each panel fits with adjacent panels to form a corner 14 of the segment. The panels 12 form an angle of approximately 120° at each corner 14. In alternative embodiments, the number of panels in a segment of sheet piling may vary along with their relative angles to each other.

The two segments 10*a* and 10*b* are connected at a joint. One panel 10*a* has a male joint attachment 16, while the other panel 10*b* has a female joint attachment 18. These two attachments 16 and 18 fit together to form the joint that interlocks the segments 10*a* and 10*b*. Multiple segments are fitted together to form a length of wall. In this embodiment, each segment has a male joint attachment 16 and a female joint attachment 18 on alternative ends of the segment. In alternative embodiments, segments may have two male attachments or two female attachments.

Figure 2:
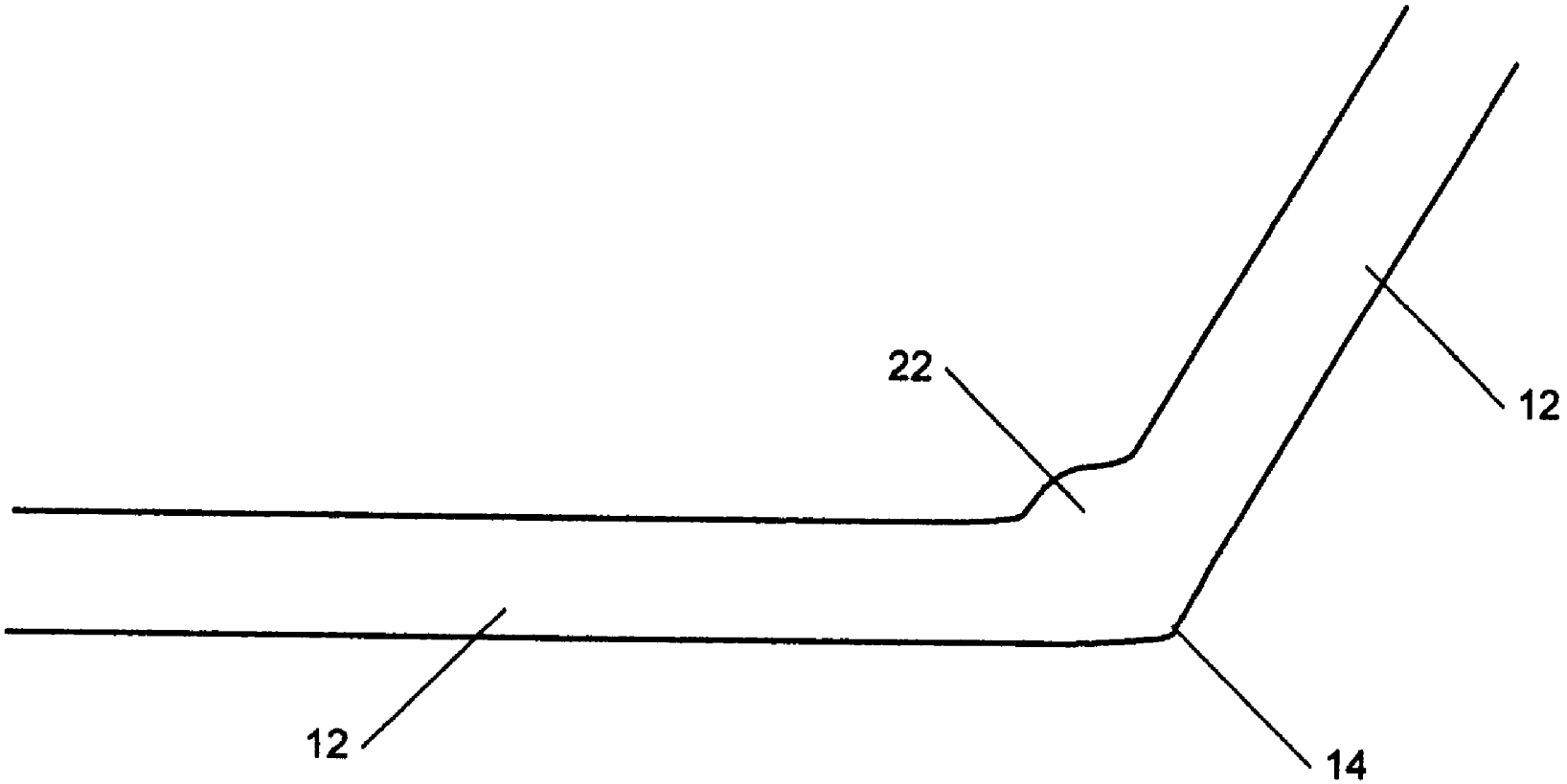
FIG. 2 shows an overhead view of a re-enforced corner of a sheet piling segment in accordance with one embodiment of the present invention.

If the segments are used to construct a seawall, forces are exerted on the panels 12 and the joint on one side by soil and on the other side by water. In the present embodiment, the segments 10*a* and 10*b* are re-enforced along the panels 20 and the corners 22 in order to prevent the segments from bulging at these points and potentially failing catastrophically. The panel re-enforcement 20 has a circular cross-section and is centered on the panel 12. An overhead view of the corner re-enforcement 22 is shown in FIG. 2 in accordance with one embodiment of the present invention. The re-enforcement 22 is centered on the corner 14 of the two panels 12 of the sheet piling segment. Re-enforcing this area of the corner 14 helps prevent the panels 12 from bulging outward and compromising the integrity of the corner 14. The re-enforcement 22 has a convex cross-sectional shape that maximizes the re-enforcement strength for the corner while optimizing the use of materials to manufacture the sheet. A re-enforcement with a convex cross-sectional shape is particularly suited for used with anisotropic materials such as FRPs. A convex re-enforcement helps prevent rupturing of a matrix of fibers in the material.

Figure 3:
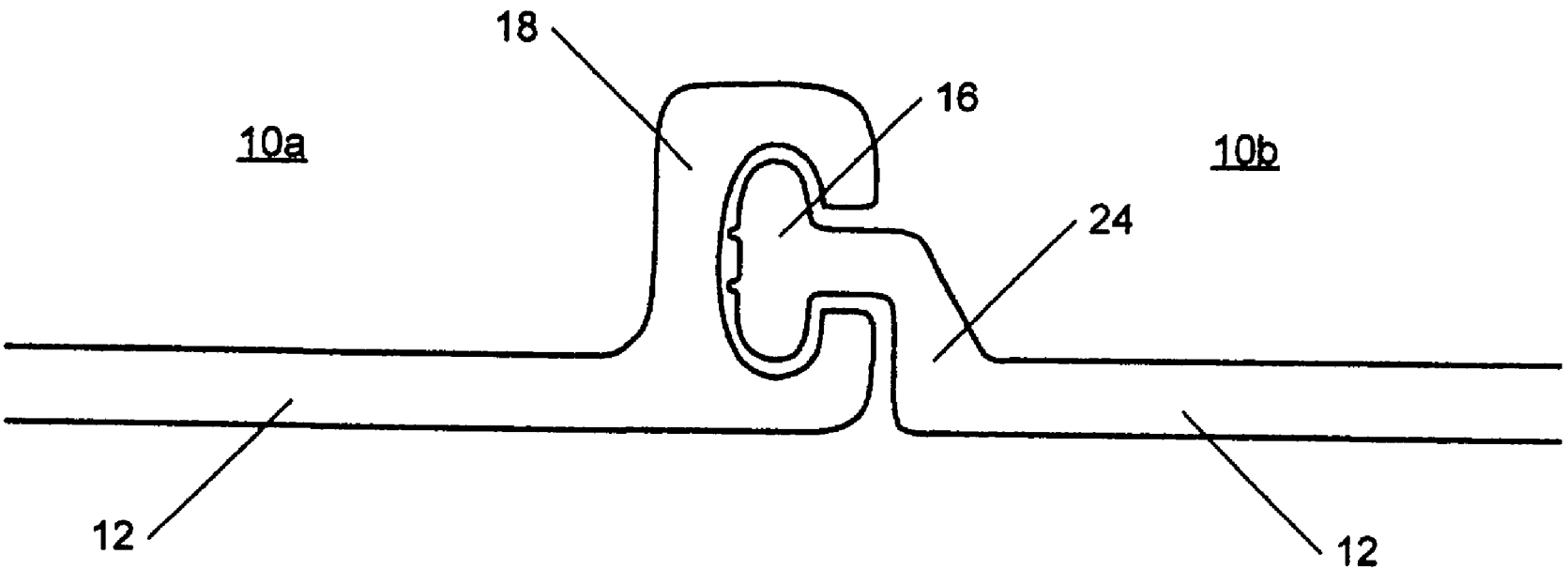
FIG. 3 shows and overhead view of a joint of two joined sheet piling segments in accordance with one embodiment of the present invention.

In order to prevent separation of the sheet piling segments 10*a* and 10*b* at the joint, the male joint attachment 16 is re-enforced between the attachment 16 and its panel 12. An overhead view of the male joint attachment re-enforcement 24 is shown in FIG. 3 in accordance with one embodiment of the present invention. The re-enforcement 24 is centered between the panel 12 and the male attachment 16. Re-enforcing this area of the attachment 16 helps prevent twisting and buckling of the male attachment 16 that would result in its separation from the female attachment 18. The re-enforcement 24 has a triangular cross-sectional area that maximizes the re-enforcement strength of the attachment 16 while optimizing the use of materials. A triangular shaped re-enforcement 24 is used due to the 90° angle between the panel 12 and the bottom of the male attachment 16.

In some embodiments, the dimensions of the sheet may be 18 inches long (i.e., the linear length from the male attachment to the female attachment of a segment) and 8 inches wide (i.e., the linear distance between the two end panels of the segment). The segment may have a height of several feet or longer. The thickness of a panel of the segment may be 0.25 inches. In alternative embodiments, these dimensions may vary accordingly.

The segment of sheet piling may be made of polyurethane material. Polyurethane is a material with hydrophobic properties of low water absorption, even when the outer skin has been breached (e.g., by drill holes). The material is also highly impact resistant and stable under prolonged exposed to ultra-violet (UV) radiation and saltwater. In typical applications, polyurethane may be "heat cured". Curing is a chemical process where a liquid material (e.g., a resin) cross-links to form a solid. The curing process may be initiated or accelerated by the application of heat. It is commonly done during the molding process and may take a few seconds to a few hours for completion depending on the materials involved.

Polyurethane elastomers are one member of a large family of elastic polymers called rubber. Polyurethane may be a liquid that can be molded into any shape or size. It is formed by reacting a polyol (an alcohol with more than two reactive hydroxyl groups per molecule) with a diisocyanate or a polymeric isocyanate in the presence of suitable catalysts and additives. The chemical formula for polyurethane is: $C_3H_8N_2O$. A wide variety of diisocyanates and polyols can be used to produce polyurethane in alternative embodiments. It should be understood that the term "polyurethane" includes a wide variety of thermoplastic polyurethane elastomers that are manufactured differently and may have different performance characteristics.

In an alternative embodiment, polyurethane may be used as a base component of a multi-component mixture. Such a multi-component material includes: a hardening catalyst such as isocyanate and a resin such as polyurethane. The advantage of a multi-component mixture is that it does not require heat during the curing process. In alternative embodiments, alternative materials could be used that are suitable as a hardening catalyst and a resin.

In an alternative embodiment, a polyurethane based material (either alone as a single component material of polyurethane or in a multi-component material) is used with re-enforcing fibers to form the sheet piling segments. The segments are manufactured by a process called "pultrusion". With the pultrusion process, the fibers are pulled through a wet bath of polyurethane resin. The fibers are wetted with polyurethane by the bath. The wet fibers are then cast into a matrix to increase the structural strength of the segment. The matrix may be a woven pattern whose design may vary to increase the strength of the finished product. The material is then pulled through a die where the segment of sheet piling is formed. The segment is then heat cured to solidify the polyurethane and complete the manufacture of the segment. The fibers used in the process may be made of glass, carbon, or other suitable material that provides strength to the material.

In an alternative embodiment, sheet piling segments may be made of standard FRP materials with a water-resistant gel coating applied to the surface of the piling. The gel-coating will prevent absorption of water by the underlying FRP material and consequently prevent weakening of the integrity of the sheet piling segment. An example of a suitable material for use as a gel coating is a "neopental isothalic acid resin" system. This material protects FRPs from water absorption while it also resists barnacles and other parasites. In other embodiments, other suitable water-resistant materials could be applied to the surface of the FRP to prevent water absorption.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A segment of seawall sheet piling, comprising:

a polyurethane based material;

a woven pattern matrix of fibers that re-enforce the polyurethane based material; and where the segment of seawall sheet piling is formed by pultrusion in the shape of multiple sheet piling segments that fit together at angles that are re-enforced with a convex cross-sectional shaped re-enforcement.

2. The segment of claim 1, where the polyurethane based material is a single component material.

3. The segment of claim 1, where the polyurethane based material is a multi-component material.

4. The segment of claim 3, where the multi-component material comprises:

a hardening catalyst, and a resin.

5. The segment of claim 4, where the hardening catalyst is isocyanate.

6. The segment of claim 4, where the resin is polyurethane.

7. The segment of claim 1, where the polyurethane based material is heat cured.

8. The segment of sheet piling of claim 1, where the fibers are glass.

9. A segment of sheet piling, comprising:

a fiber re-enforced polymer material;

a matrix of fibers that re-enforce the fiber re-enforced polymer material; and a water resistant coating that is applied to the surface of the segment.

10. The segment of claim 9, where the gel-coating is neopental isothalic acid resin.

11. The segment of claim 9, where the matrix is a woven pattern.

12. The segment of claim 9, where the fibers are glass fibers.

* * * * *